US011673704B2

(12) United States Patent
Obenshain et al.

(10) Patent No.: US 11,673,704 B2
(45) Date of Patent: Jun. 13, 2023

(54) MECHANISM FOR LABEL SIZE SELECTION

(71) Applicant: Panduit Corp., Tinley Park, IL (US)

(72) Inventors: Marc R. Obenshain, Cumming, GA (US); Thuc K. Vu, Plainfield, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 17/498,913

(22) Filed: Oct. 12, 2021

(65) Prior Publication Data

US 2022/0127034 A1 Apr. 28, 2022

Related U.S. Application Data

(60) Provisional application No. 63/105,497, filed on Oct. 26, 2020.

(51) Int. Cl.

| | |
|---|---|
| ***B65C 9/42*** | (2006.01) |
| ***B65C 9/00*** | (2006.01) |
| ***B65C 9/18*** | (2006.01) |
| ***B65H 35/00*** | (2006.01) |

(52) U.S. Cl.

CPC ..... *B65C 9/42* (2013.01); *B65C 9/0006* (2013.01); *B65C 9/1865* (2013.01); *B65H 35/0066* (2013.01); *B65H 2701/194* (2013.01)

(58) Field of Classification Search

CPC ..... B65C 3/02; B65C 9/0006; B65C 9/1865; B65C 9/42

See application file for complete search history.

(56) References Cited

U.S. PATENT DOCUMENTS

| | | | | |
|---|---|---|---|---|
| 3,245,860 | A | 4/1966 | Aurich et al. | |
| 3,337,103 | A | 8/1967 | Shaft et al. | |
| 4,867,833 | A * | 9/1989 | McCoy | B65C 9/42 156/542 |
| 4,931,127 | A | 6/1990 | Matsumoto | |
| 5,071,030 | A * | 12/1991 | Marcusen | B65C 9/0006 221/73 |
| 5,587,043 | A | 12/1996 | Hying et al. | |
| 5,718,525 | A | 2/1998 | Bruhnke et al. | |
| 5,875,618 | A | 3/1999 | Kiel et al. | |
| 6,349,756 | B1 | 2/2002 | Brough et al. | |
| 6,544,378 | B2 | 4/2003 | Brough et al. | |
| 6,742,858 | B2 | 6/2004 | Lehmkuhl et al. | |
| 6,766,844 | B1 | 7/2004 | Watkins | |
| 6,857,801 | B2 | 2/2005 | Van Bever | |
| 6,875,304 | B2 | 4/2005 | Bandholz et al. | |

(Continued)

FOREIGN PATENT DOCUMENTS

| | | | |
|---|---|---|---|
| DE | 102008047251 | A1 | 3/2010 |
| EP | 1832519 | B1 | 12/2008 |

*Primary Examiner* — Philip C Tucker
*Assistant Examiner* — John Blades
(74) *Attorney, Agent, or Firm* — Christopher S. Clancy; James H. Williams; Aimee E. McVady

(57) ABSTRACT

A mechanism used to select a label size to be applied to a cable in a label applicator. The mechanism includes an index plate, an index arm, and a wedge carrier. The index arm is pivotably mounted to the index plate and the wedge carrier is mounted to the index plate. The wedge carrier has guide rollers that dictate a label path. The index arm moves the index plate which linearly moves the wedge carrier thereby adjusting the label path in the label applicator.

15 Claims, 11 Drawing Sheets

(56) References Cited

U.S. PATENT DOCUMENTS

| | | | | |
|---|---|---|---|---|
| 7,014,139 | B2 | 3/2006 | Bandholz et al. | |
| 7,178,572 | B2 | 2/2007 | Bandholz et al. | |
| 7,231,952 | B2 | 6/2007 | Bandholz et al. | |
| 7,469,736 | B2 | 12/2008 | Fries et al. | |
| 7,757,739 | B2 | 7/2010 | Dyer et al. | |
| 8,033,312 | B2 | 10/2011 | Dyer et al. | |
| 8,186,408 | B2 | 5/2012 | Dyer et al. | |
| 8,454,785 | B1 | 6/2013 | Bennett et al. | |
| 8,708,018 | B2 | 4/2014 | Boulay et al. | |
| 8,783,318 | B2 | 7/2014 | Witkiewicz | |
| 9,446,877 | B1 | 9/2016 | Bennett et al. | |
| 9,868,559 | B2 | 1/2018 | Dubniczki et al. | |
| 9,950,826 | B1 | 4/2018 | Bennett et al. | |
| 10,035,618 | B1 | 7/2018 | Bennett et al. | |
| 10,710,761 | B2 | 7/2020 | Buxton et al. | |
| 2002/0084014 | A1* | 7/2002 | Klein | B65C 9/1869 156/64 |
| 2011/0017392 | A1 | 1/2011 | Erives | |
| 2018/0079545 | A1* | 3/2018 | McNestry | B65C 9/0006 |
| 2019/0263552 | A1 | 8/2019 | Nelson et al. | |

* cited by examiner

MECHANISM FOR LABEL SIZE SELECTION

CROSS REFERENCE TO RELATED APPLICATION(S)

This application claims benefit to U.S. Provisional Patent Application No. 63/105,497 filed on Oct. 26, 2020, the entirety of which is hereby incorporated by reference herein.

FIELD OF THE INVENTION

The present invention relates to a benchtop label applicator assembly, and more particularly to a mechanism for label size selection for the benchtop label applicator assembly.

BACKGROUND OF THE INVENTION

Label applicators have been designed to wrap labels around a cable without spinning the cable along the longitudinal axis. The label applicators can include an internal printer that prepare labels for wire, cables or other elongated objects of varying diameters. Alternatively, label applicators can apply pre-printed labels to the wires, cables or other elongated objects of varying diameters. The pre-printed labels are presented on spools that are attached to the label applicator. When it is desirable to apply a different size label, the pre-printed label spool is replaced with a pre-printed label spool of the desired size labels.

Thus, it would be desirable to provide a label applicator that allows repeatable changeover between label sizes without multiple pre-printed label spools or additional tooling.

SUMMARY OF THE INVENTION

The present invention is directed to a mechanism designed to select a label size in a label applicator. The mechanism includes an index plate with an index arm pivotably mounted to the index plate. A wedge carrier is mounted to the index plate. The wedge carrier includes guide rollers and a peel blade that from a peel wedge which dictates a label path for the label in the label applicator. The movement of the index plate by the index arm linearly moves the wedge carrier and attached guide rollers and peel blade thereby adjusting the label path in the label applicator.

DETAILED DESCRIPTION

The present invention is directed towards a mechanism that allows an operator to select the label size they will be working with and mechanical adjustments to the label applicator to accommodate the specific label size.

Figure 1:
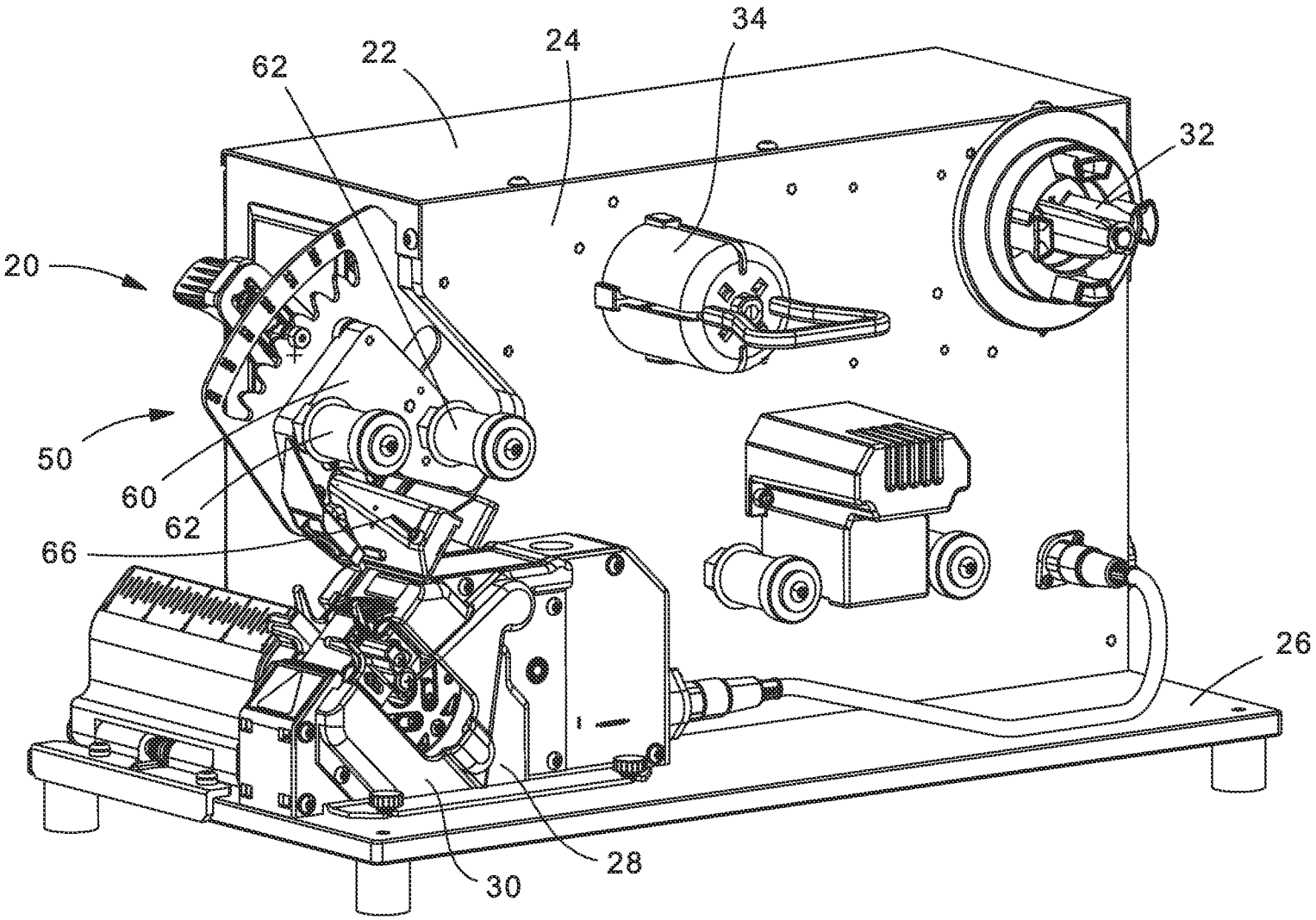
FIG. 1 is a perspective view of the benchtop label applicator with the selectable peel and present mechanism of the present invention.

FIG. 1 illustrates a bench top label applicator 20 with an electrical enclosure 22 on a base plate 26, an applicator head assembly 28 that includes a label wrapping system 30, a spindle 32 for receiving a spool of pre-printed labels, and a label liner rewind 34. A selectable peel and present subassembly 50 is mounted to the vertical plate 24 of the electrical enclosure 22 and positioned above the applicator head assembly 28.

Figure 2:
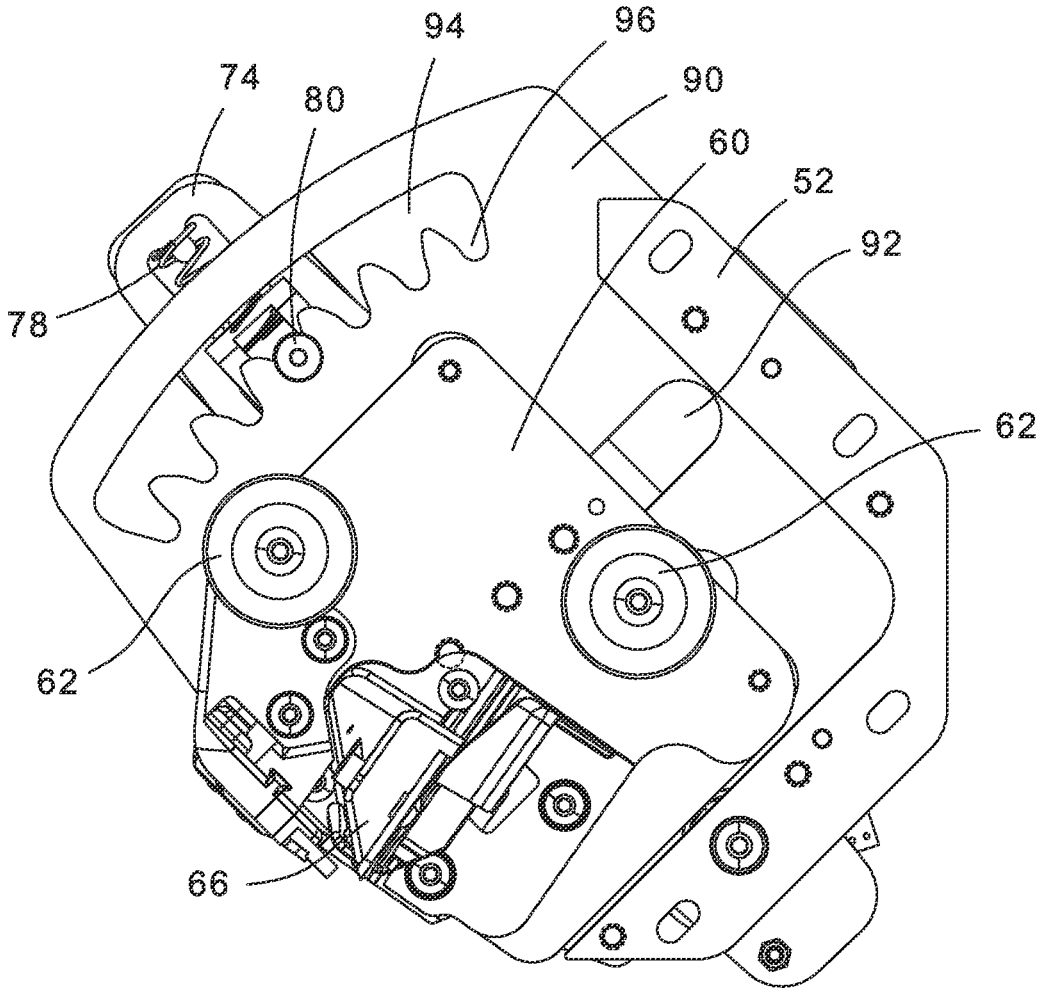
FIG. 2 is a right side view of the selectable peel and present mechanism of FIG. 1.
Figure 3:
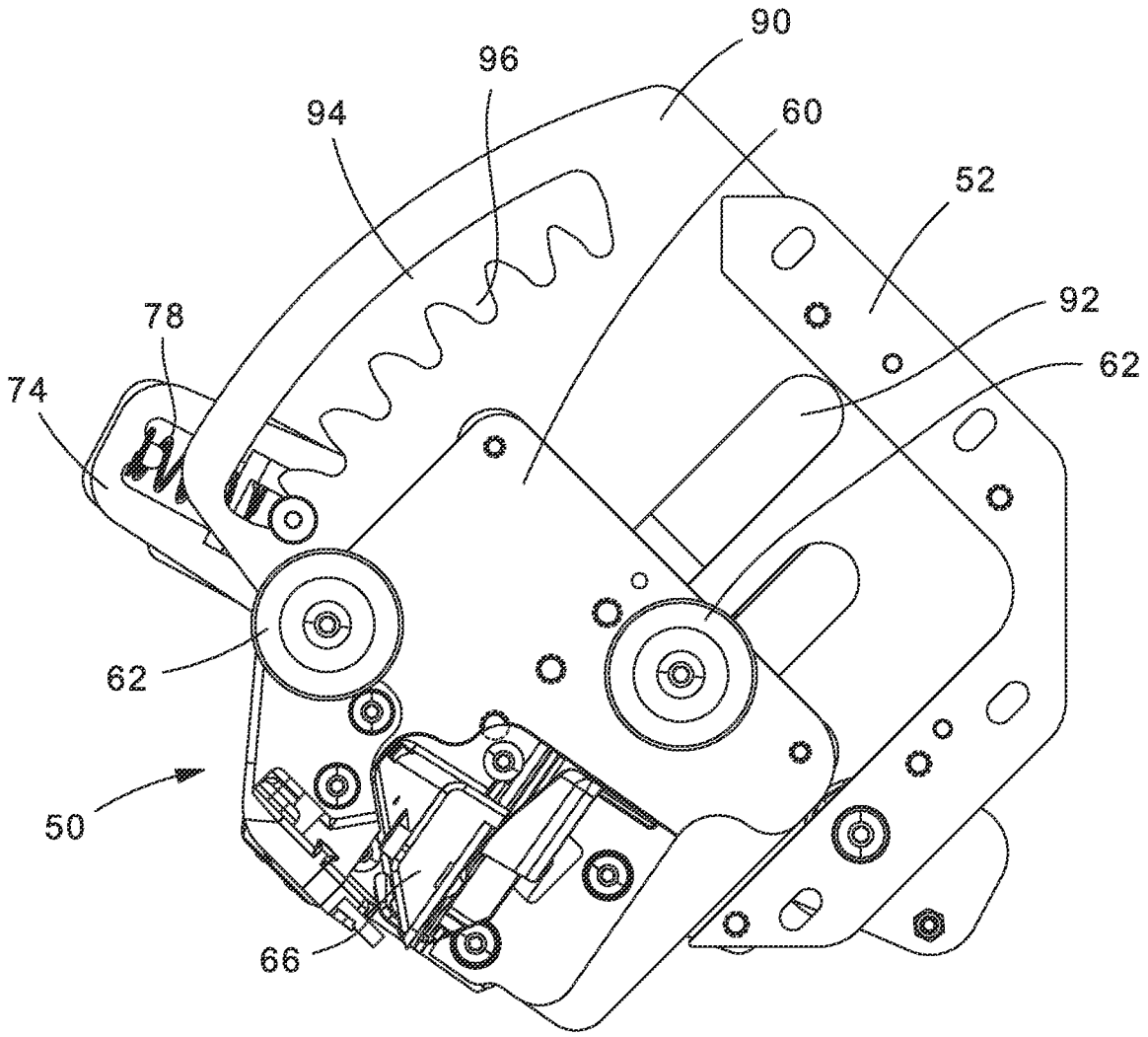
FIG. 3 is a right side view of the selectable peel and present mechanism of FIG. 1 with the index arm in a forward position.
Figure 4:
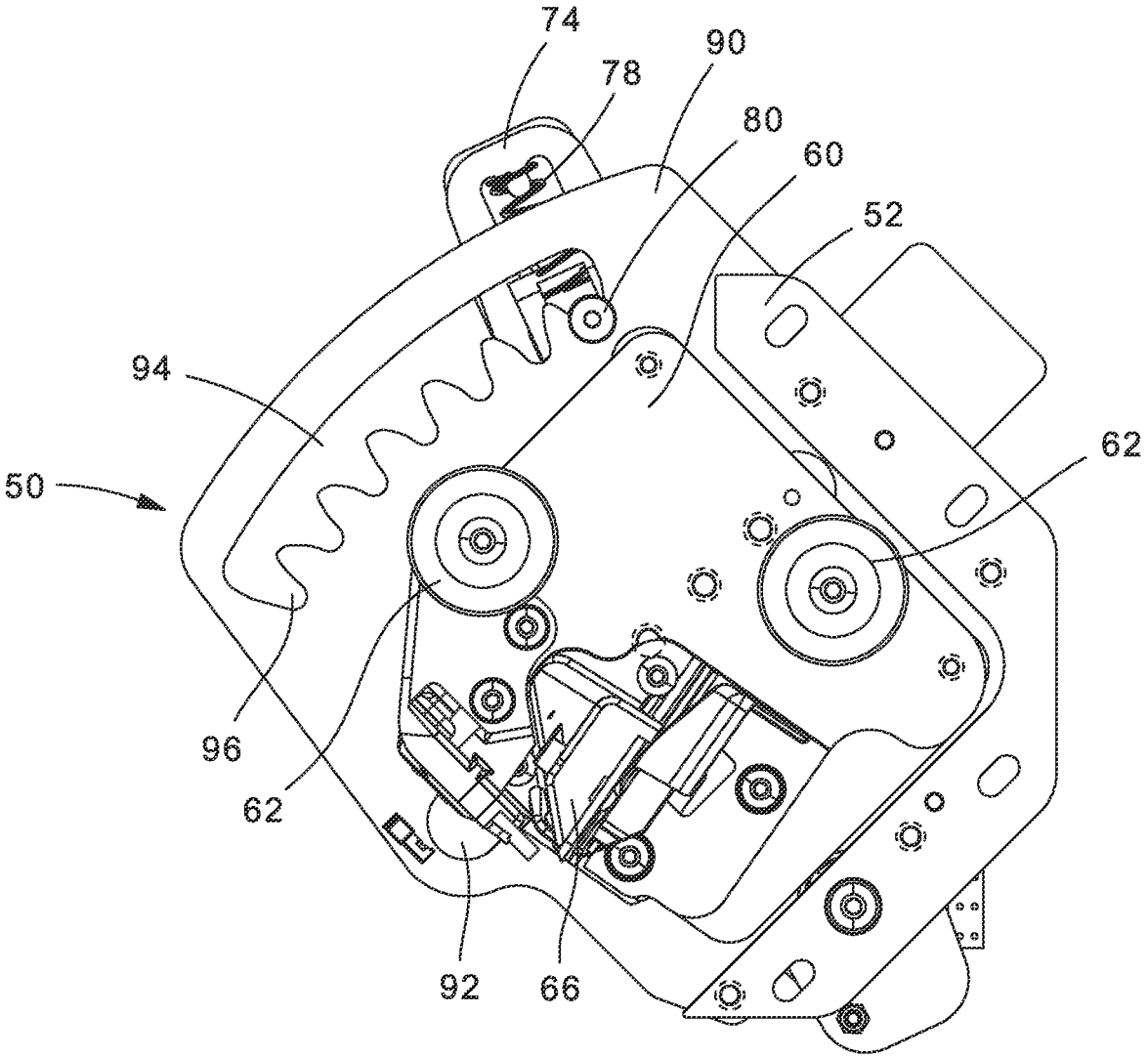
FIG. 4 is a right side view of the selectable peel and present mechanism of FIG. 1 with the index arm in a back position.

FIGS. 2-4 illustrate a side view of the selectable peel and present subassembly 50 of the present invention. The selectable peel and present subassembly 50 is easily accessible by the operator. The selectable peel and present subassembly 50 is designed to adjust the label path in the label applicator 20 to accommodate various label sizes to be affixed to cables. The selectable peel and present subassembly 50 includes the components that make up a peel wedge for the present invention. The peel wedge is the shape of the media or label path as viewed from the side of the label applicator 20. The location of the peel wedge with respect to the applicator head dictates the size or length of the label that is going to be applied to the cables. The shape of the peel wedge is also crucial to consistent peeling of the label that is applied to the cables.

The peel wedge is formed by two guides rollers 62 and the peel blade 68, which is under the blade carrier 66. The components that form the peel wedge are attached to the wedge carrier 60. As described below, the wedge carrier 60 is directly translated along the index slot 92 (FIGS. 9-10) in the index plate 90 by the operator through the index arm 74.

As illustrated in FIGS. 3 and 4, the index plate 90 includes an index pattern 94 with a number of slots 96 that receive an index bolt 80 of the index arm 74. Each slot 96 defines the distance the peel wedge is located from the applicator head 28. The operator can move the index arm 74 to be positioned in one of several slots 96 in the index pattern 94. FIG. 3 illustrates the index arm 74 and wedge carrier 60 in a forward most position and FIG. 4 illustrates the index arm 74 and wedge carrier 60 in a back position. When the operator moves the index arm 74, the peel wedge components are moved to a proper distance away from the applicator head 28 to accommodate the specific label size that the operator wants to apply to the cable.

Figure 5:
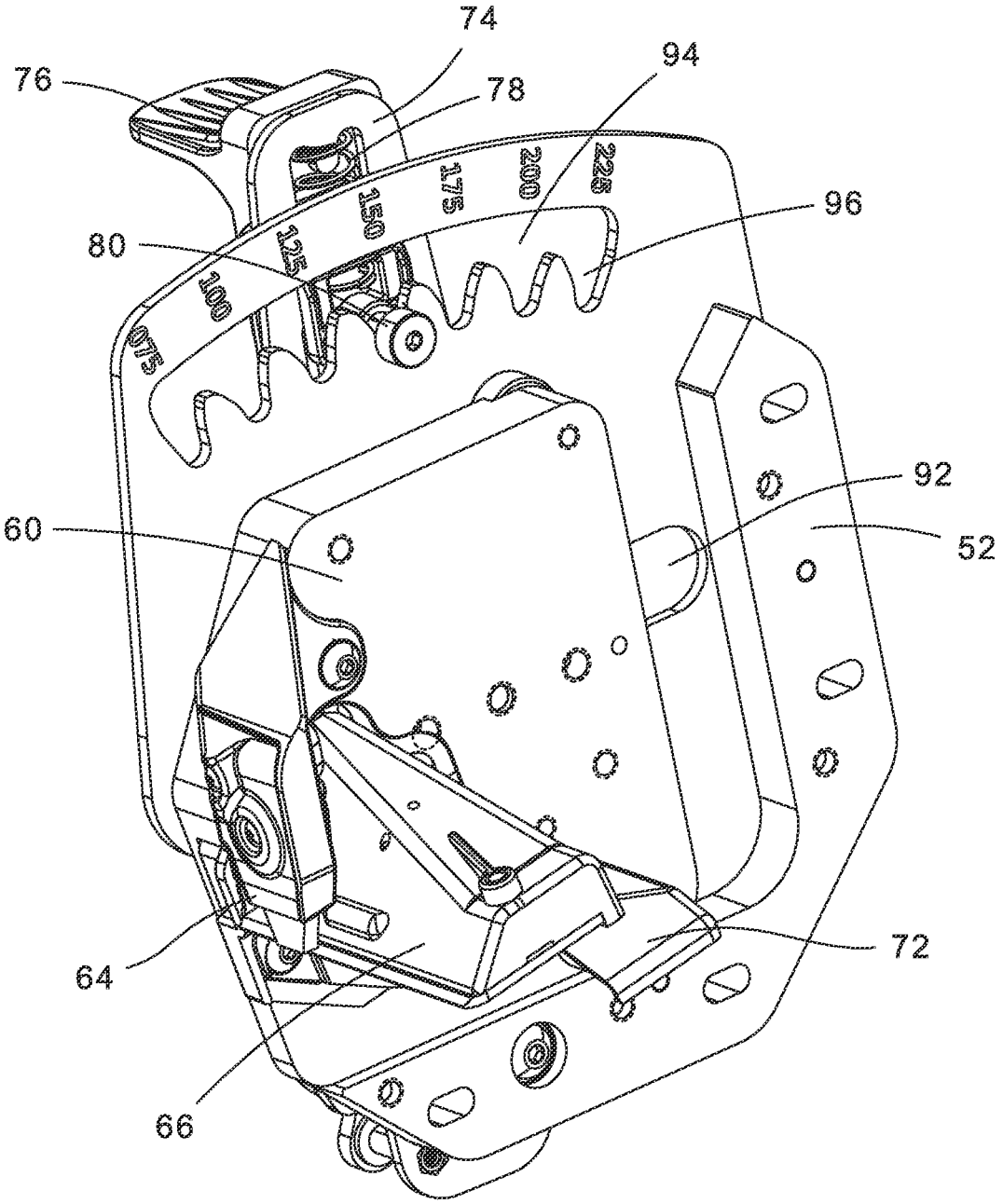
FIG. 5 is a right side perspective view of the selectable peel and present mechanism of FIG. 1.

FIGS. 5-11 further illustrate the selectable peel and present subassembly 50. As illustrated in FIG. 5, the right side of the selectable peel and present subassembly 50 includes an index spacer 52, a wedge carrier 60, a label presence sensor and housing 64, a blade carrier 66 and an emitter arm 72. The guide rollers 62 that extend from the wedge carrier 60, as illustrated in FIGS. 1-4, have been omitted for clarity.

Figure 6:
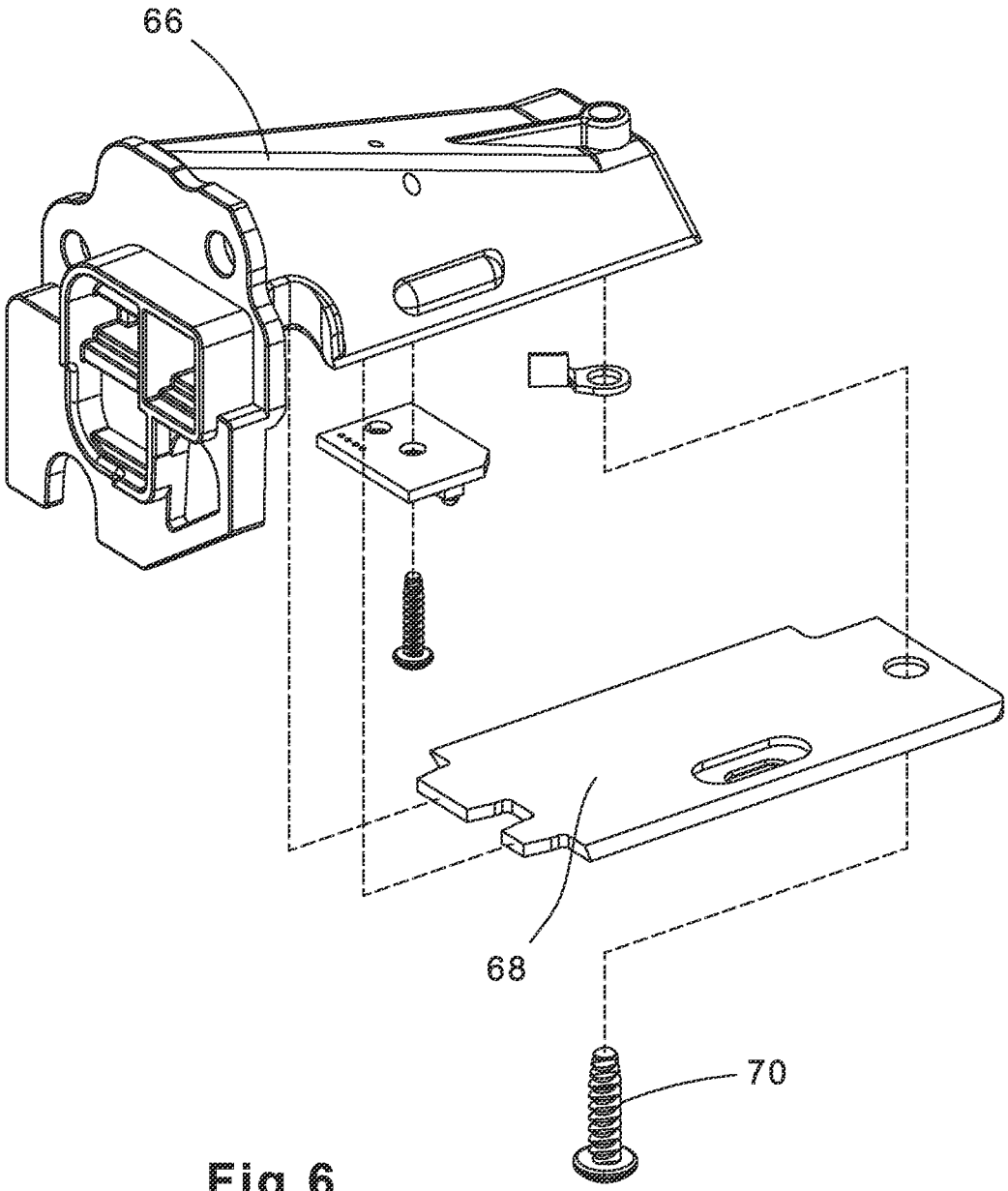
FIG. 6 is an exploded view of the blade carrier of the selectable peel and present mechanism of FIG. 5.

FIG. 6 illustrates an exploded view of the blade carrier 66 that extends from the wedge carrier 60. The blade carrier 66 includes a peel blade 68 that is secured to the bottom of the blade carrier 66 via fasteners 70.

Figure 7:
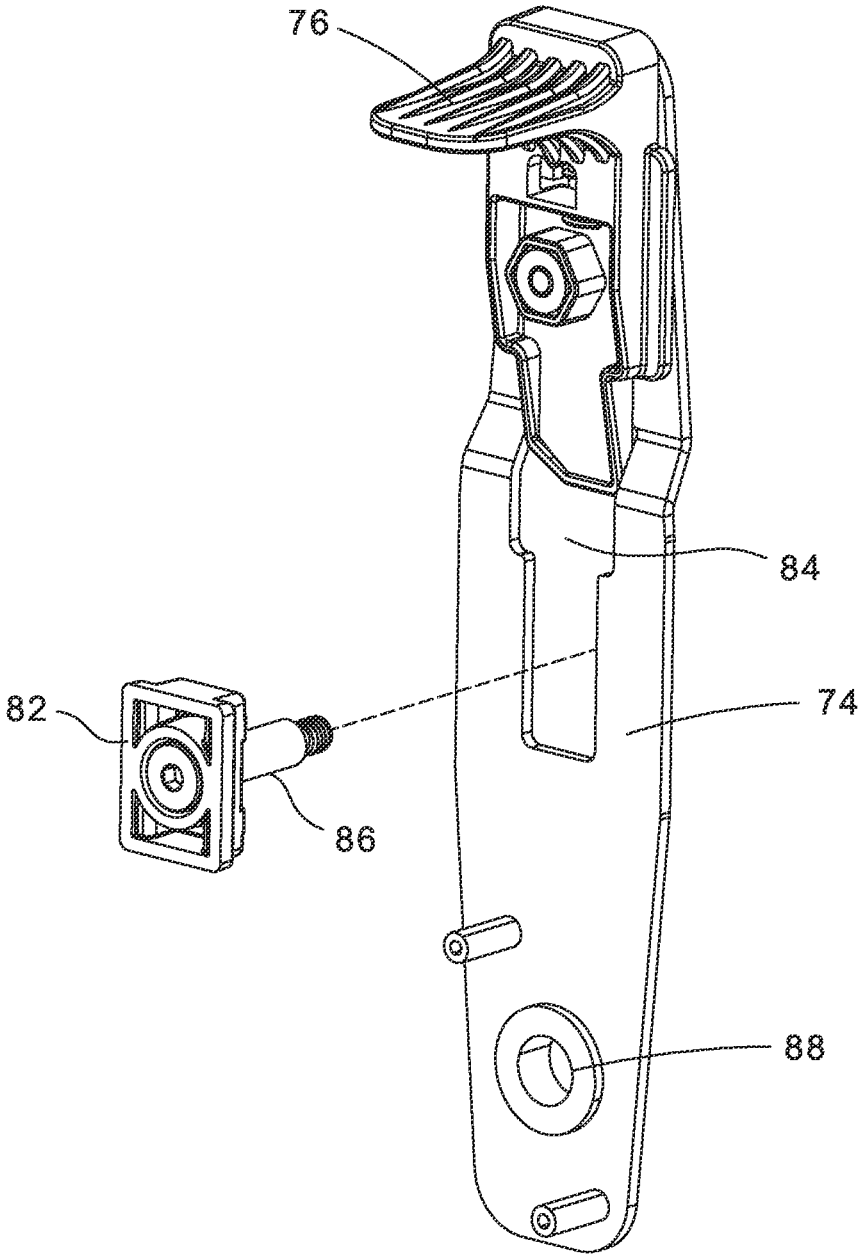
FIG. 7 is a left side perspective view of the index arm of the selectable peel and present mechanism of FIG. 5.
Figure 8:
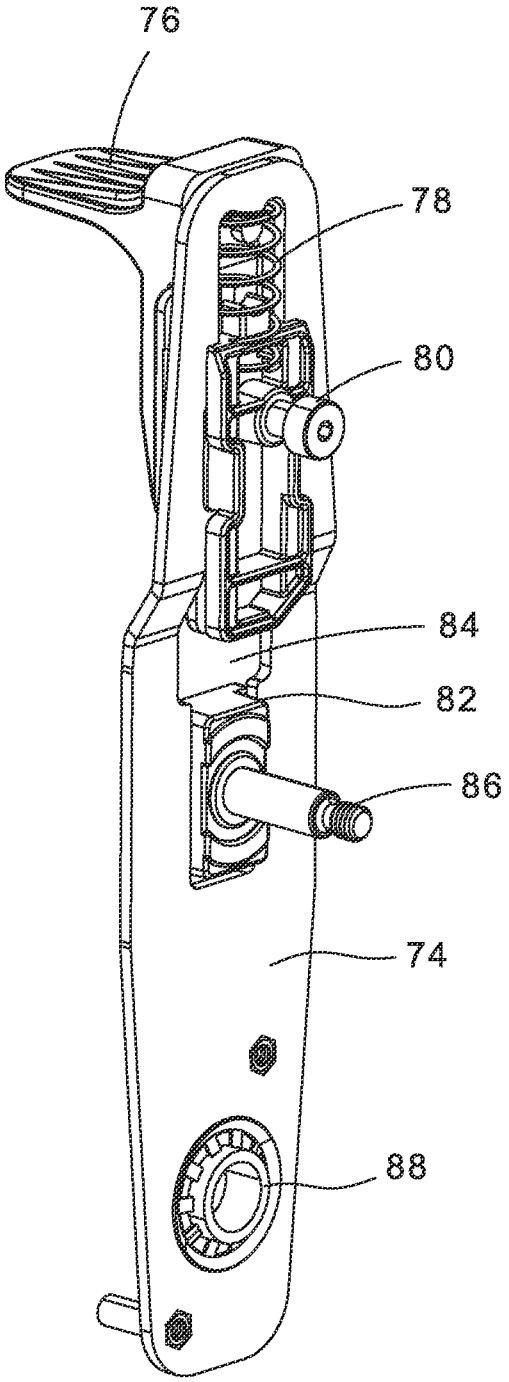
FIG. 8 is a right side perspective view of the index arm of the selectable peel and present mechanism of FIG. 5.

FIGS. 7 and 8 illustrate the index arm 74 that is secured to the selectable peel and present subassembly 50. As described above, the index arm 74 enables the operator to engage the wedge carrier 60. The index arm 74 includes an indexer 76, a spring 78, an index bolt 80 secured to the indexer 76, a pivot bearing 82 with a pivot bolt 86 located in a slot 84 in the index arm 74, and an index arm bushing 88. The indexer 76 is spring biased so that once the operator releases the indexer 76, the spring 78 forces the indexer 76 back to its initial position.

To change the position of the index arm 74 with respect to the slots 96 in the index plate 90, the operator lifts the indexer 76 and attached index bolt 80 out of the current slot 96 of the index pattern 94 in the index plate 90. While still holding the indexer 76 up, the operator can move the indexer 76 and index arm 74 to another position along the index plate 90. As discussed above, FIG. 3 illustrates the indexer 76 in the forward most position and FIG. 4 illustrates the indexer 76 in a back position. When the operator releases the indexer 76, the spring 78 returns the indexer 76 down and combined with the shape of the slots 96 in the index plate 90, holds the index bolt 80 into position within one of the slots 96.

The pivot bearing 82 translates the motion of the index arm 74 to the wedge carrier 60 and attached peel wedge components. The pivot bearing 82 rides linearly in a slot 84 in the index arm 74. A pivot bolt 86 extends through the pivot bearing 82 and affixes into the wedge carrier 60. The pivot bearing 82 moves rotationally around the pivot bolt 86, and relative to the wedge carrier 60.

Leverage to move the wedge carrier 60 is created by the index arm's 74 movement around the index arm bushing 88, which mounts to the pivot shaft 54 (see FIG. 9) on the index spacer 52. The index arm 74 is retained on the selectable peel and present subassembly 50 by the pivot bearing bolt 86 and a nut on the pivot shaft 54.

Figure 9:
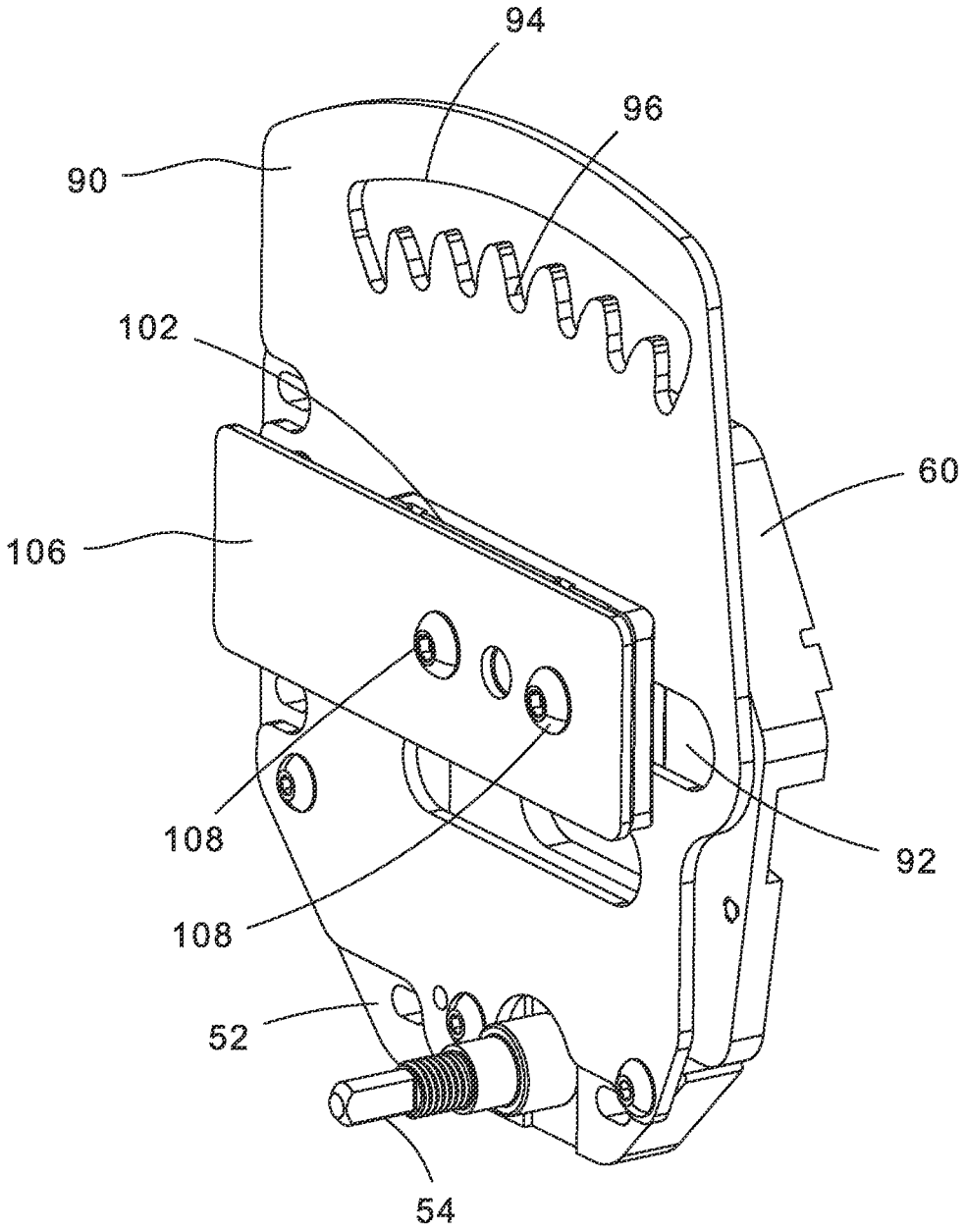
FIG. 9 is a left side perspective view of the index plate and wedge carrier of the selectable peel and present mechanism of FIG. 5.
Figure 10:
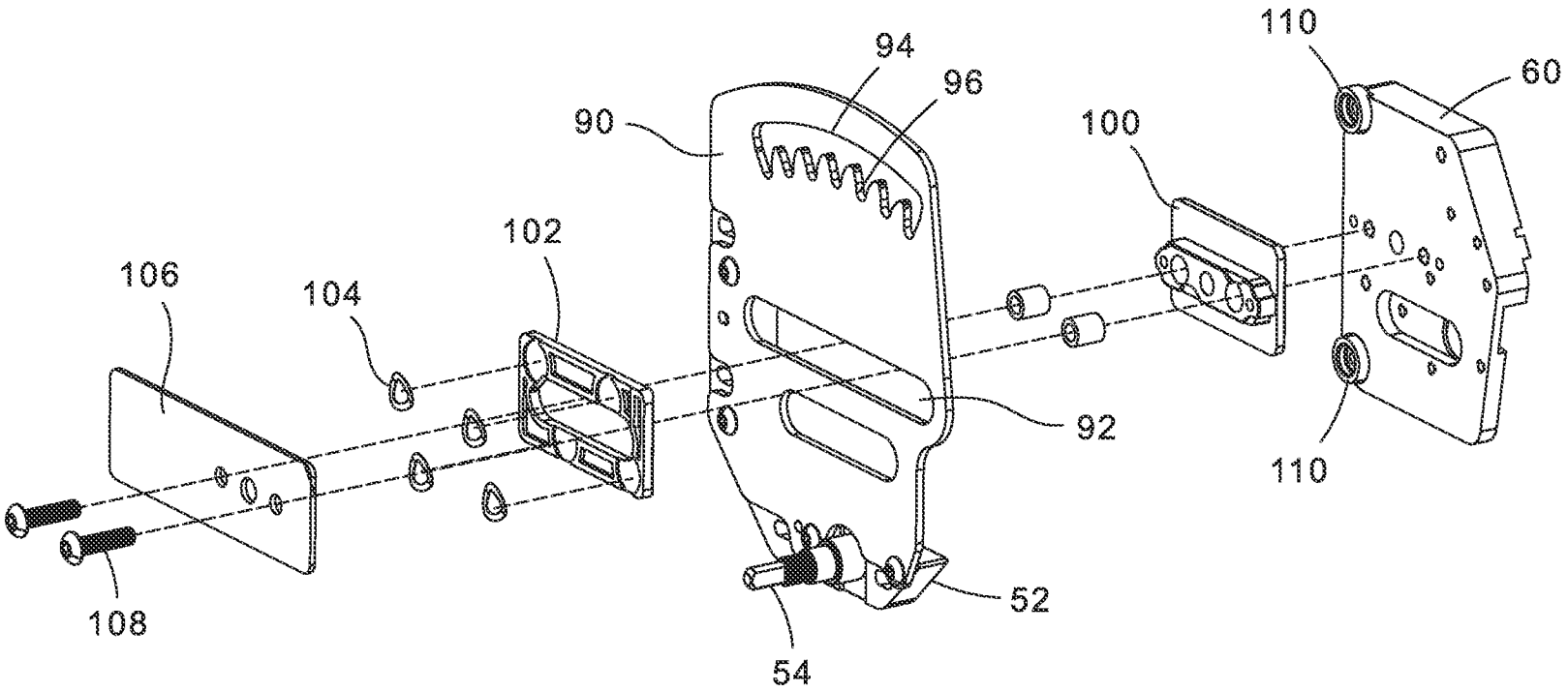
FIG. 10 is an exploded perspective view of the index plate and the wedge carrier of FIG. 9.

FIG. 9 illustrates the left side of the selectable peel and present subassembly 50 without the index arm 74 installed. FIG. 10 is an exploded view of the selectable peel and present subassembly 50 without the index arm 74 installed. The wedge carrier 60 is attached to the index plate 90 via nylon plastic bearings 100, 102. A portion in a first bearing 100 fits into the index slot 92 in the index plate 90, which forces the wedge carrier 60 to follow a linear motion, despite the arcing motion of the index arm 74. A second bearing 102 is mounted with compression springs 104 between the second bearing 102 and the backing plate 106 to apply a compressive force to the selectable peel and present subassembly 50 so that the second bearing 102 is drawn against the index plate 90. This reduces free movement of the subassembly 50 that would occur through a tolerance stackup. Compression bolts 108 reach through all of the components and thread into the wedge carrier 60, to hold the subassembly 50 together. A pair of limit bearings 110 are positioned on the wedge carrier 60. The limit bearings 110 reduce undesirable deflection of the subassembly 50 around the compression springs 104 when web tension is applied through the peel blade 68 by changing the point where the subassembly 50 would pivot and involving all compression springs 104 in resisting deflection of the subassembly 50.

Figure 11:
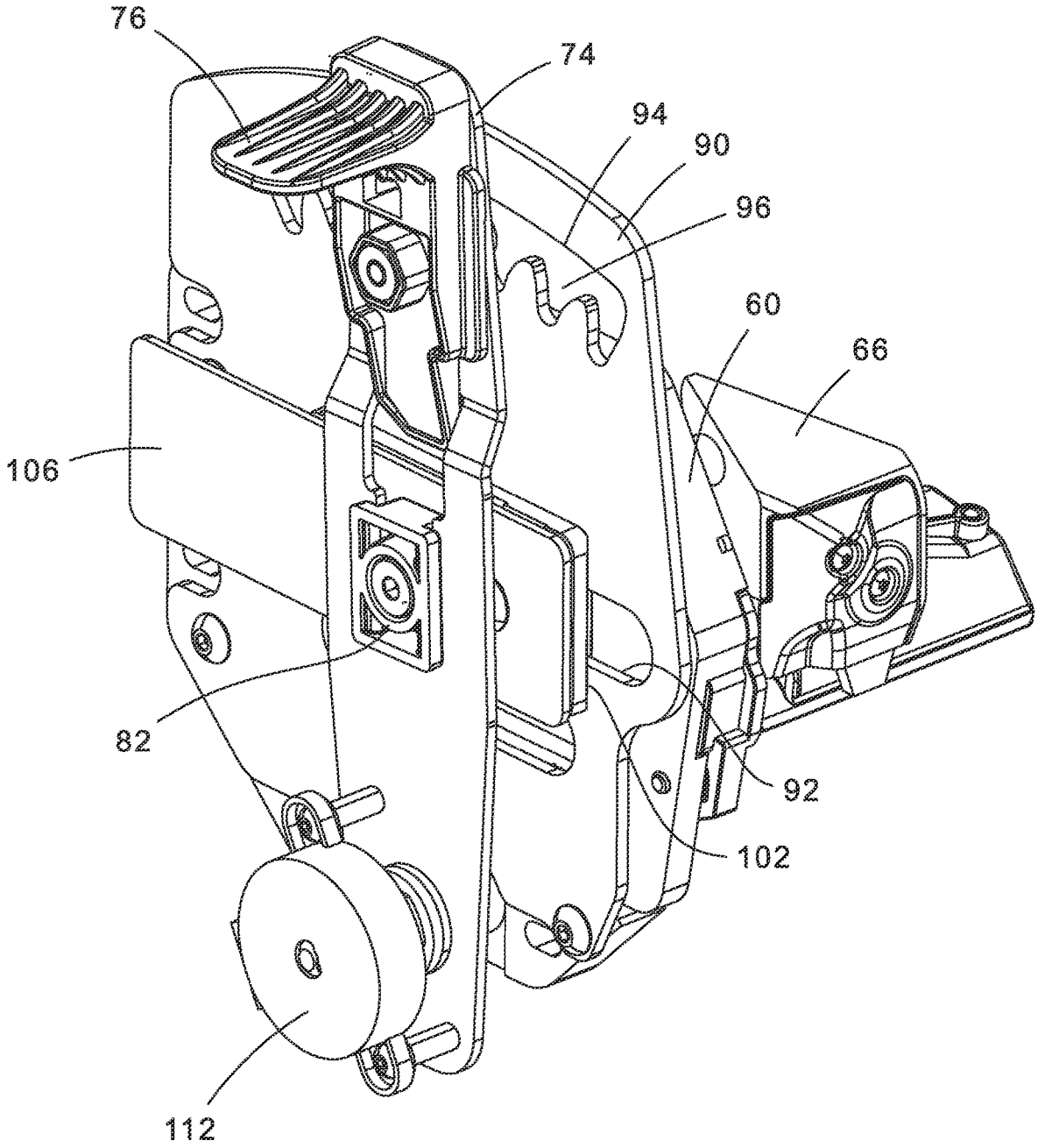
FIG. 11 is a left side perspective view of the selectable peel and present mechanism of FIG. 1.

FIG. 11 illustrates a right perspective view of the selectable peel and present subassembly 50. The index arm 74 is secured to the index plate 90 via the pivot bearing 82 and the bearing assembly. An indexer position sensor 112 is attached to the index arm 74. The sensor 112 is a rotary potentiometer that allows the label applicator 20 to determine the position of the index arm 74, thus reducing label selection errors. The indexer position sensor 112 is fixed against rotation to the index arm 74 and keyed through its center with a sleeve to a mating feature in the pivot shaft 54 thereby ensuring consistent orientation.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A mechanism for label size selection for a label to be applied to a cable in a label applicator, the mechanism comprising:

an index plate with an index arm pivotably mounted to the index plate, wherein the index plate having an index pattern with a number of slots for receiving and maintaining the index arm, wherein the index arm has an indexer, a spring, and an index bolt secured to the indexer, the indexer extends from one side of the index arm and the index bolt extends from the index arm from a side opposite the indexer; the index bolt extends through one of the number of slots in the index pattern to maintain the index arm in a desired position; and a wedge carrier mounted to the index plate, wherein the wedge carrier dictates a label path;

whereby movement of the index plate by the index arm linearly moves the wedge carrier thereby adjusting the label path in the label applicator.

2. The mechanism of claim 1, wherein the index arm has a slot and a pivot bearing positioned within the slot, a pivot bolt extends through the pivot bearing and affixes to the wedge carrier, wherein the pivot bearing translates motion of the index arm to the wedge carrier.

3. The mechanism of claim 1, wherein the index arm further comprises an index arm bushing adapted to be mounted to a pivot shaft extending from an index spacer mounted to the index plate.

4. The mechanism of claim 1, wherein the wedge carrier has guide rollers and a blade carrier housing a peel blade.

5. The mechanism of claim 4, wherein the guide rollers and the peel blade define a peel wedge that forms the label path in the label applicator.

6. The mechanism of claim 1, further comprises a label presence sensor and housing mounted to the wedge carrier.

7. The mechanism of claim 1, wherein an index spacer is mounted to the index plate, the index spacer has a pivot shaft adapted to receive the index arm.

8. A selectable peel and present subassembly mounted to a label applicator for applying a label to a cable, the selectable peel and present subassembly comprising:

an index plate with an index arm pivotably mounted to the index plate;

wherein the index plate having an index pattern with a number of slots for receiving and maintaining the index arm, wherein the index arm has an indexer, a spring, and an index bolt secured to the indexer, the indexer extends from one side of the index arm and the index bolt extends from the index arm from a side opposite the indexer; the index bolt extends through one of the number of slots in the index pattern to maintain the index arm in a desired position; and a wedge carrier mounted to the index plate, the wedge carrier houses components forming a peel wedge, wherein the components of the peel wedge are adapted to be positioned a desired distance away from an applicator head on the label applicator;

whereby the selectable peel and present assembly adjusts a label path in the label applicator for accommodating various label sizes to be affixed to cables.

9. The selectable peel and present subassembly of claim 8, wherein the index arm has a slot and a pivot bearing positioned within the slot, a pivot bolt extends through the pivot bearing and affixes to the wedge carrier, wherein the pivot bearing translates motion of the index arm to the wedge carrier.

10. The selectable peel and present subassembly of claim 8, wherein the index arm further comprises an index arm bushing adapted to be mounted to a pivot shaft extending from an index spacer mounted to the index plate.

11. The selectable peel and present subassembly of claim 8, wherein the wedge carrier has guide rollers and a peel blade housed in a blade carrier to define the peel wedge; whereby the guide rollers and the peel blade form the label path in the label applicator.

12. The selectable peel and present subassembly of claim 8, wherein an index spacer is mounted to the index plate, the index spacer has a pivot shaft adapted to receive the index arm.

13. The selectable peel and present subassembly of claim 8, wherein the wedge carrier is secured to the index plate by a first bearing and a second bearing, the first bearing is positioned in an index slot in the index plate, the second bearing is mounted to the first bearing that extends through the index slot.

14. The selectable peel and present subassembly of claim 13, further comprises compression springs and a backing plate mounted to the second bearing to draw the second bearing against the index plate.

15. A mechanism for label size selection for a label to be applied to a cable in a label applicator, the mechanism comprising:

an index plate with an index arm pivotably mounted to the index plate and an index slot;

a wedge carrier dictating a label path for the label; and a first bearing and a second bearing secure the wedge carrier to the index plate, the first bearing is positioned in the index slot in the index plate, the second bearing is mounted to the first bearing that extends through the index slot; and compression springs and a backing plate are mounted to the second bearing to draw the second bearing against the index plate;

whereby the wedge carrier is translated along the index slot in the index plate by the index arm thereby adjusting the label path in the label applicator.

* * * * *